United States Patent [19]

Bruce

[11] 4,032,041

[45] June 28, 1977

[54] DISPENSING APPARATUS HAVING TEMPERATURE COMPENSATING FLUID METERING

[75] Inventor: Ralph E. Bruce, Dayton, Ohio

[73] Assignee: Production Control Units, Inc., Dayton, Ohio

[22] Filed: Aug. 11, 1975

[21] Appl. No.: 603,759

[52] U.S. Cl. ..... 222/14; 222/54; 222/63; 250/231 R

[51] Int. Cl.[2] ..... B67D 5/30

[58] Field of Search ..... 250/231 R, 237 G; 222/14, 16, 77, 63, 54

[56] References Cited

UNITED STATES PATENTS

| | | | |
|---|---|---|---|
| 2,775,870 | 1/1957 | Bruce et al. | 222/16 |
| 3,743,140 | 7/1973 | Sauerbrey | 222/63 |
| 3,752,363 | 8/1973 | Fegley et al. | 222/63 |

*Primary Examiner*—Robert B. Reeves
*Assistant Examiner*—David A. Scherbel
*Attorney, Agent, or Firm*—Jacox & Meckstroth

[57] ABSTRACT

A plurality of refrigeration units are successively charged with a liquid refrigerant which is dispensed by a positive displacement pump including a hydraulically actuated ram or piston slidably supported within a dispensing cylinder. An elongated tension coil spring extends parallel to the axis of the cylinder, and the piston carries a photosensing device which senses the helical turns of the spring when the piston is actuated to provide corresponding electrical pulses which are counted for precisely controlling the axial movement of the piston and the displacement of the refrigerant into each refrigeration unit. The length of the spring and the uniform spacing or pitch of the helical turns is automatically changed in response to changes in temperature of the refrigerant being dispensed to assure that each refrigeration unit is charged with precisely the desired weight of refrigerant regardless of changes in temperature of the refrigerant. Controls are also provided for controlling the counting of the spring turns and the displacement of the piston in response to changes in compressibility of the refrigerant with changes in temperature.

18 Claims, 3 Drawing Figures

110V
1000 PSI
AMPLIFIER & PULSE SHAPER
START
STOP
COUNTER
REFERENCE
CONTROL RELAYS
SOL V1
SOL V2
D.C. LAMP
HYDRAULIC RESERVOIR

DISPENSING APPARATUS HAVING TEMPERATURE COMPENSATING FLUID METERING

BACKGROUND OF THE INVENTION

In the production of refrigeration units which are commonly used in refrigerators, freezers, air conditioners, walk-in coolers, and the like, it is necessary to charge each unit with a predetermined weight of liquid refrigerant such as the refrigerants commonly referred to in the industry as R-12, R-22, R-500 and R-502 and which may be purchased under the trademark Freon. The weight of the charge of liquid refrigerant depends on the size of the refrigeration unit and commonly ranges from a few ounces, such as used in a refrigeration unit for a water cooler drinking fountain, to over 15 pounds such as used in an industrial air conditioning system. Usually, the charge is expressed in pounds and ounces avoirdupois, but there is a growing demand for charging in the metric system of grams and kilograms.

Since the density of the liquid refrigerant decreases as the temperature of the refrigerant increases, and visa versa, it has been found highly desirable to maintain the liquid refrigerant at a substantially constant temperature during the successive charging operations, for example, as disclosed in U.S. Pat. No. 2,631,437 which issued to assignee of the present invention, or to adjust the weight of the liquid refrigerant dispensed into each refrigerating unit in accordance with changes in temperature of the refrigerant. U.S. Pat. No. 2,775,870, which also issued to the assignee of the present invention, discloses a liquid refrigerant metering and dispensing device which automatically compensates for changes in temperature of the liquid refrigerant which is normally stored at room temperature or within the range of 70° F. to 90° F.

It has been found desirable for a liquid refrigerant dispensing or metering system to be designed and constructed for operating within an ambient temperature range of 50° F. to 120° F. and to compensate automatically for changes in density of the refrigerant within this temperature range. The metering and dispensing device disclosed in above mentioned U.S. Pat. No. 2,775,870 provides this automatic compensation by means of a printed electrical circuit contact board or panel which included a series of metal contact lines having a non-corroding outer layer of gold. A sliding electrical contact element is connected for axial movement with the displacement ram or cylinder and successively engages the contact lines until it contacts the line which is connected to control the solenoid valve through which hydraulic fluid enters the cylinder to actuate the displacement piston. As illustrated in the patent, the contact lines are arranged in diverging relation, and the contact board or panel is adjusted laterally relative to the axis of the piston in response to changes in temperature of the liquid refrigerant so that the stroke of the displacement ram or piston will change when the temperature of the refrigerant changes. The arrangement of the contact lines and the lateral adjustment of the contact board are calibrated according to the changes in density of a particular refrigerant with changes in temperature.

While the adjustable contact board or panel has performed very successfully for many years, contact boards have become more and more costly to produce, and a larger inventory of contact board must be maintained to accommodate the increasing number of different liquid refrigerants and the different sizes of the metering and dispensing devices. In addition, once a contact board or panel has been designed and constructed, it is inflexible and cannot be easily corrected or altered, for example, to compensate for an error or to adjust the contact panel so that it may be used with a different refrigerant.

It is also apparent that the adjustable contact panel system has practical limitations with respect to providing for selecting incremental changes in the rate of refrigerant to be dispensed. For example, the contact panel system used on a six pound refrigerant dispensing system, provides for selecting or changing the weight of liquid refrigerant dispensed in increments of ½ ounce. However, it has occasionally been found desirable to provide for selecting the weight of liquid to be dispensed in increments of less than ½ ounce. It is also difficult to produce a sliding contact panel assembly which corresponds to the metric system and provides for dispensing liquid refrigerant in grams and kilograms.

SUMMARY OF THE INVENTION

The present invention is directed to a liquid or fluid metering and dispensing apparatus which incorporates improved means for successively dispensing charges of liquid refrigerant or fluid of uniform weight regardless of changes in temperature of the refrigerant or fluid. The apparatus of the invention is conveniently adjustable for accommodating different liquid refrigerants and may be calibrated precisely so that a precise weight of liquid refrigerant is dispensed with each charge. The dispensing apparatus also provides for improved resolution in that a charge of liquid refrigerant may be selected in fine increments, thereby providing for dispensing each charge of refrigerant within relatively close tolerances.

The present invention also provides a dispensing apparatus which is less expensive to construct and maintain in comparison with a dispensing device using an adjustable sliding contact panel. The apparatus is also adapted to be easily calibrated for dispensing in the metric system and is compatible with a digital control, read out and printing system as well as a computer control system. In addition, the fluid dispensing apparatus of the invention provides for automatically compensating the weight of the charge dispensed in accordance with charges of the compressibility of the liquid refrigerant with changes in temperature of the refrigerant.

In accordance with one embodiment of the invention, the above desirable features and advantages are generally provided by a dispensing apparatus which incorporates an elongated tension coil spring which extends parallel to the axis of a hydraulically actuated displacement piston within a cylinder. A light and photosensing unit is supported for axial movement with the displacement piston and is positioned to provide electrical pulses for the helical turns of the spring. The pulses are counted as the displacement piston moves, and when a preselected count is attained, the hydraulic actuated displacement piston stops so that a preselected weight of liquid refrigerant is dispensed or charged into the refrigerating unit.

The length of the coil tension spring and thus the uniform pitch between adjacent turns of the spring is automatically changed or adjusted in response to changes in temperature of the liquid refrigerant, and the spring length and pitch may also be conveniently adjusted for accommodating different liquid refrigerants. The point where the photosensing unit commences counting the helical turns of the spring, is also adjusted in response to changes in temperature of the liquid refrigerant to provide for automatically compensating for changes of compressibility of the refrigerant with changes in temperature.

Other features and advantages of the invention will be apparent from the following description, the accompanying drawing and the appended claims.

DESCRIPTION OF THE PREFERRED EMBODIMENT

Figures 1, 2, 3:
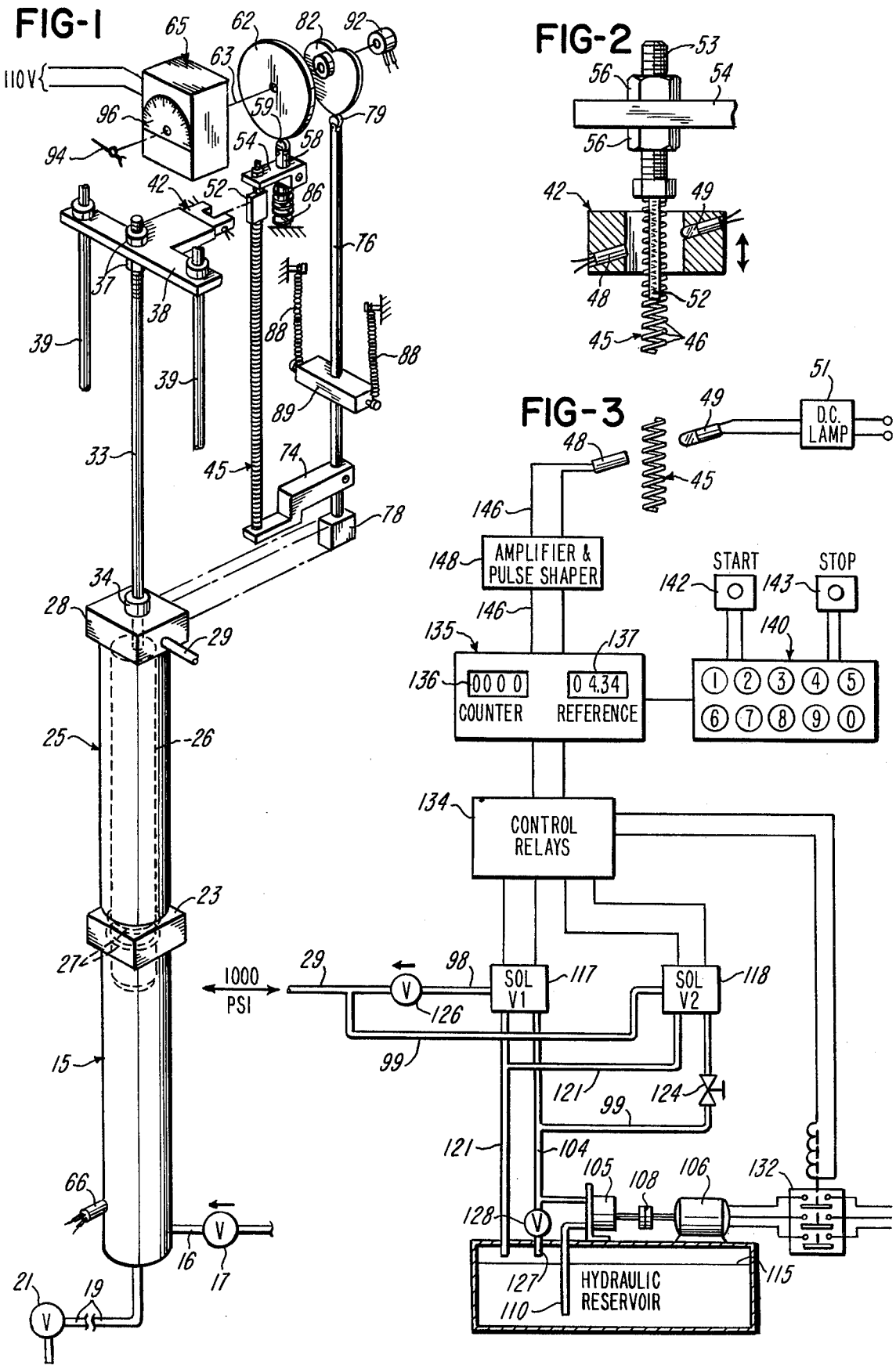
FIG. 1 is a diagrammatic and fragmentary perspective view of fluid metering and dispensing apparatus constructed in accordance with the invention and which is adapted for charging a refrigeration unit with a precise weight of liquid refrigerant.
FIG. 2 is an enlarged fragmentary section of a portion of the apparatus shown in FIG. 1.
FIG. 3 is a diagram of the system for actuating and controlling the dispensing apparatus shown in FIG. 1.

Referring to FIG. 1, the dispensing and metering apparatus of the invention is adapted for use in charging a predetermined weight of liquid refrigerant into a refrigeration unit after all moisture and air are evacuated from the unit. The refrigerant is received within a displacement type metering or dispensing cylinder 15 which is connected by a line 16 to a refrigerant source (not shown) such as a tank of liquid refrigerant compressed at a predetermined pressure, for example, 250 psi. The line 16 includes a check valve 17 to assure that the refrigerant flows only into the cylinder 15 for discharge or dispensing through a discharge line 19 which may be connected to a portable dispensing gun incorporating a pressure responsive valve 21. The valve 21 is set to open when the liquid refrigerant within the line 19 reaches a predetermined pressure, for example, 600 psi.

The dispensing cylinder 15 is connected by a coupling member or block 23 to a fluid or hydraulic actuating cylinder 25 which encloses an elongated cylindrical displacement ram or piston 26. The piston 26 extends through the coupling block 23 which also retains a pair of axially spaced o-ring resilient seals 27 for forming a fluid-tight sliding seal between the piston 26 and the block 23. The actuating cylinder 25 includes an upper closure member or head block 28 through which hydraulic fluid is supplied to the cylinder 25 through a L-shaped passage connected to a hydraulic fluid supply line 29. As will be explained later, when it is desired to move the ram or piston 26 downwardly for displacing liquid refrigerant within the dispensing cylinder 15, hydraulic fluid is supplied to the actuating cylinder 25 through the line 29 at a predetermined pressure, for example, 1000 psi.

An enlongated cylindrical rod 33 has its lower end portion rigidly secured to the upper end portion of the displacement piston 26 and projects upwardly through a fluid-tight seal enclosed within a fitting 34 secured to the headblock 28 of the cylinder 25. The upper end portion of the rod 33 is adjustably connected by a pair of adjusting nuts 37 to a bracket 38 which is supported for vertical sliding movement by a pair of spaced vertical guide rods 39 so that the bracket 38 moves vertically or axially with the displacement piston 26.

A U-shaped sensing unit 42 is carried by the bracket 38 and defines a gap through which extends a vertical coil tension spring 45. The spring 45 is formed of spring wire of small diameter and has over 500 helical turns 46 with a predetermined pitch between adjacent turns. The unit 42 carries a light sensing element or photocell 48 which is adapted to sense the light produced from an electrical lamp or light source 49 connected to a D.C. power supply 51. The photocell 48 and light source 49 are positioned so that their common optical axis corresponds to or is parallel to the incline of the helical turns 46 of the spring 45. Thus when the light source 49 is energized and the unit 42 moves vertically along the spring 45 in response to movement of the displacement piston 26, the light transmitted from the light source 49 to the photocell 48 is interrupted by each helical turn 46 of the spring 45. Thus the photocell 48 produces an electrical pulse corresponding to each turn 46 of the spring 45.

The upper end portion of the coil spring 45 is threaded into a series of holes formed within a flat vertical light blocking plate 52 which is formed as an integral part of an adjustment screw 53. The screw 53 extends through a hole within an upper support arm 54 and is adjustably secured to the arm 54 by a pair of adjustable lock nuts 56. The support arm 54 is supported for vertical sliding movement and is adjustably secured or clamped to a vertical cam rod 58. A roller type cam follower 59 is secured to the upper end portion of the rod 58 and engages the outer peripheral surface of a disc-like cam 62 adjustably mounted on the output shaft 63 of a reversible servo control motor 65. The motor 65 is adapted to receive electrical power from a 110 volt power supply and is operated in response to the control of a temperature sensing device or RTD 66 mounted on the wall of the dispensing cylinder 15. The RTD 66 is effective to sense the temperature of the liquid refrigerant received within the dispensing cylinder 15.

The lower end portion of the tension coil spring 45 is connected to a lower support arm 74 which is adjustably secured or clamped to a vertical cam rod 76 having its lower end portion slidably supported by a guide block 78 projecting from the headblock 28 of the actuating cylinder 25. The upper end portion of the cam rod 76 carries a follower roller 79 which engages the outer peripheral surface of a disc-like cam 82. The cam 82 is positioned adjacent the cam 62 and is also adjustably secured to the output shaft 63 of the servo motor 65. A compression spring 86 is positioned to urge the roller follower 59 into continuous engagement with the cam 62, and a pair of tension springs 88 are connected to a bar 89 secured to the cam rod 76 for urging the cam follower 79 in continuous engagement with the cam 82.

A variable resistor or potentiometer 92 is varied with rotation of the shaft 63 and is connected with the temperature sensing device 66 in a bridge circuit (not shown) for controlling relays which actuate the servo motor 65. The shaft 63 is adapted to rotate in reverse directions through an angle of approximately 160° in response to changes in temperature of the liquid refrigerant received within the dispensing cylinder 15. An indicator 94 is connected to rotate with the shaft 63 and provide a visual indication of the refrigerant temperature on a graduated scale 96 which is calibrated for a predetermined temperature range, for example, 50° F. to 120° F.

Referring to FIG. 3, hydraulic fluid is supplied at a substantially constant pressure (e.g., 1000 psi) to the actuating cylinder 25 through the fluid line 29. The line 29 is connected through fluid lines 98 and 99 to a line 104 extending from the output of a positive displacement fluid pump 105 driven by an electric motor 106 through a coupling 108. Preferably, the pump 105 is of the sliding vane type and has an inlet which is connected by a line 110 extending into a hydraulic oil supply or reservoir 115. A set of solenoid actuated valves 117 and 118 control the flow of fluid through the lines 98 and 99 to the line 29, and return lines 121 extend from the valves 117 and 118 to the reservoir 115. The supply line 99 which connects the lines 29 and 104, also include an adjustable needle valve 124, and the supply line 98 is provided with a one-way check valve 126. The output of the pump 105 is also connected to the reservoir 115 by a return line 127 and a pressure responsive valve 128.

The pump drive motor 106 is operated by a three phase electrical power supply line controlled by a solenoid actuated switch 132. The switch 132 and the solenoid actuated valves 117 and 118 are actuated or controlled by a relay control system 134 which, in turn, is controlled by an electronic digital control system 135. One source for the control system 135 is Electronic Research Co., a division of Textron. The system 135 includes a digital counter display 136 and a digital reference display 137. The reference display 137 is selected or preset by a push button digital selection unit 140 which is connected to a main start switch 142 and an emergency stop switch 143. The digital control system 135 is connected to the photocell 48 by a line 146, and the signals or pulses received by the photocell 48 are amplified and shaped into a square wave form by an amplifier and pulse shaper unit 148 which is connected in the line 146.

In operation of the fluid metering and dispensing apparatus described above, the disc-like cams 62 and 82 are constructed for a particular liquid refrigerant, for example, R-12 or R-22. The cam 62 is shaped to provide for adjustment of the upper arm 54 (FIG. 2) and the upper spring retaining plate 52 in accordance with the changes of the compressibility of the refrigerant with changes in temperature. The cam 82 is shaped to produce adjustment of the lower support arm 74 and the length of the tension coil spring 45 in accordance with changes in density of the refrigerant with changes in temperature.

When it is desired to inject or dispense a predetermined weight of liquid refrigerant into a refrigeration unit through the pressure responsive valve 21, the predetermined weight, for example, 04.34 pounds, is entered on the control unit 140 so that it appears on the reference display 137. The pressure of the liquid refrigerant within the supply tank, for example, 250 psi, is effective to fill the dispensing cylinder 15 with liquid refrigerant and to move or shift the displacement piston 26 to its upper home position, as shown in FIG. 1. The temperature sensing unit 66 senses the temperature of the liquid refrigerant within the dispensing cylinder 15 and actuates the servo motor 65 to position the cams 62 and 82 according to the temperature of the refrigerant. The temperature of the refrigerant within the cylinder 15 is also visually displayed on the scale 96 by the indicator 94. The dispensing of a predetermined charge of liquid refrigerant is initiated by depressing the push button start switch 142 causing the counter display 136 to indicate the desired weight of the charge corresponding to the reference display 137. The control system 135 actuates the relays 134 to energize the solenoids 117 and 118 and the pump drive motor 106.

The hydraulic fluid at a predetermined pressure is pumped through the line 29 into the actuating cylinder 25 so that the piston 26 is forced downwardly to displace the liquid refrigerant within the dispensing cylinder 15 and thus force the refrigerant outwardly through the line 19 for discharge through the valve 21. As the piston 26 moves downwardly, the photocell 48 senses the helical turns 46 of the spring 45, and the electrical pulses produced by the photocell 48 are counted by the control system 135. Thus if the spring is calibrated so that each helical turn corresponds to .01 pound of refrigerant, for example, after a total count of 434 turns, the display counter 136 will read 0, and the control system 135 actuates the control relays 134 to close the solenoid valve 118 and deenergize the motor 106.

A few counts before the counter reaches the full count of 04.34 pounds, the control system 135 deenergizes the solenoid valve 117 so that all flow from the pump 105 to the actuating cylinder 25 is through the actuated valve 118 and the needle valve 124. The needle valve 124 is adjusted to produce slower movement of the displacement piston 26 at the lower end of its downward stroke so that the precise weight of refrigerant is dispensed, and the momentum of the displacement piston 26 does not cause the piston to overshoot the lower end of its stroke for the preselected charge of refrigerant dispensed.

As mentioned above, the rotation of the control cam 82 adjusts the level of the lower end of the spring 45 according to any charges in the temperature of the liquid refrigerant as sensed by the unit 66. When the lower end of the spring 45 is adjusted vertically, the spacing or pitch between adjacent helical turns 46 is adjusted proportionally so that the downward movement of the displacement piston 26 by a distance corresponding to the pitch of the spring, is effective to displace the corresponding weight increment by weight of liquid refrigerant.

The rotation of the cam 62 and vertical adjustment of the plate 52 in accordance with the changes in compressibility of the refrigerant with changes in temperature, controls when the photocell 48 begins sensing the helical turns 46 at the lower end of the light blocking plate 52. That is, the light source 49 and photocell are illustrated in FIG. 2 at the upper home position of the displacement piston 26. Thus when the temperature of the liquid refrigerant increases and the compressibility of the refrigerant increases correspondingly, the cam 62 automatically moves the arm 54 and spring retainer plate 52 downwardly by a fraction of an inch. As a result, the displacement piston 26 will move correspondingly further downwardly for initially compressing the liquid refrigerant within the dispensing cylinder 25 before the photocell 48 sees the light from the light source 49 at the lower end of the plate 52 and commences counting of the spring turns 46.

From the drawing of the above description, it is apparent that a fluid metering and dispensing apparatus constructed in accordance with the present invention, provides a number of desirable features and advantages. For example, the control system, including the coil tension spring 45 and the coil turn sensing and counting system, provides for substantial flexibility. That is, one such control system may be used with different liquid refrigerants and different size dispensing apparatus since the system may be conveniently adjusted for a particular refrigerant. This adjustment is accomplished by either changing the length of the spring 45 and/or by rotably adjusting the disc-like cams 62 and 82 or by interchanging them with other corresponding cams. The simple cams 62 and 82 also provide for matching the nonlinearity of the change in compressibility and density of a liquid refrigerant with changes in temperature of the refrigerant, and the rotational adjustment of the cams 62 and 82 on the shaft 63 cooperates with the precision adjustment of the spring support arms 54 and 74 and the adjustment of the plate 52 to provide for precisely calibrating each dispensing apparatus for a particular liquid refrigerant.

As another important advantage, the control system for the dispensing apparatus provides for increased resolution or for dispensing a liquid refrigerant in finer increments, such as the increments of 0.01 pound which may be associated with each helical turn 46 of the spring 45. This more precise dispensing control is especially desirable in connection with the charging of small refrigeration units which require only a few ounces of refrigerant, such as the refrigeration unit employed in a water cooler. In addition, the control system may be conveniently adapted for dispensing in the metric system of grams and kilograms, and may also be used with a commercially available card printer which provides for a digital printed readout in addition to the visual digital readout of the control system 135.

As a further advantage, the control system of the apparatus is less expensive in construction and more reliable in operation than the movable sliding contact board system disclosed in above mentioned U.S. Pat. No. 2,775,870. In addition, the system compensates more precisely for changes in temperature of the liquid refrigerant being dispensed in successive charges. It is also apparent that the apparatus of the invention eliminates the need for maintaining a substantial inventory of the expensive sliding contact boards for different refrigerants and different sizes of dispensing apparatus.

While the form of dispensing herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. In apparatus for metering and dispensing a fluid and adapted to charge a refrigeration system with a liquid refrigerant, said apparatus including a positive displacement pump having a movable fluid displacement member, means for moving said displacement member to effect dispensing of the fluid, and means for controlling the movement of said displacement member in response to changes in temperature of the fluid, the improvement wherein said means for controlling the movement of said displacement member comprise a deformable control member having a plurality of spaced elements successively arranged generally in a row, means for counting said elements in response to movement of said displacement member, means responsive to said counting means for controlling the movement of said displacement member and means for deforming said control member for changing the spacing between adjacent said elements in response to changes in temperature of the fluid.

2. Apparatus as defined in claim 1 wherein said control member comprises a helical coil spring, and said means for changing the spacing between adjacent said elements comprise means for adjustably changing the length of said spring.

3. Apparatus as defined in claim 2 wherein said spring extends between two space support members, and means for moving one of said support members relative to the other said support member in response to changes in temperature of the fluid.

4. Apparatus as defined in claim 3 wherein said means for moving one of said support members for said spring, comprise a rotary cam member, drive means for rotating said cam member, and means for controlling said drive means in response to changes in temperature of the fluid.

5. Apparatus as defined in claim 2 wherein said means for counting said elements comprise an electro-optical unit, and means connected to said displacement member and supporting said electro-optical unit for scanning movement adjacent the helical turns of said spring in response to movement of said displacement member.

6. Apparatus as defined in claim 1 wherein said means for counting said elements comprise an electro-optical unit, and means supporting said electro-optical unit for scanning movement adjacent said elements in response to movement of said displacement member.

7. Apparatus as defined in claim 1 wherein said displacement member comprises a piston supported within a cylinder for axial movement, said elements of said control member are disposed in a substantially linear row extending parallel to the axis of said cylinder, and said means for counting said elements includes an element sensing unit movable with said piston.

8. Apparatus as defined in claim 1 wherein said spaced elements comprise generally helical turns of a coil spring, and said means for counting said elements include a light source and a photosensor positioned with said spring therebetween for successively sensing the turns of said spring.

9. In apparatus for metering and dispensing a fluid and adapted to charge a refrigerator system with a liquid refrigerant, said apparatus including a positive displacement pump having a movable fluid displacement member, means for moving said displacement member to effect dispensing of the fluid, and means for controlling the movement of said displacement member in response to changes in temperature of the fluid, the improvement wherein said means for controlling the movement of said displacement member comprise a plurality of spaced elements successively arranged generally in a row, means for counting said elements in response to movement of said displacement member, means for uniformly changing the spacing between adjacent said elements in response to changes in temperature of the fluid, and means for automatically controlling said means for counting said elements in response to changes in the compressibility of the fluid.

10. Apparatus as defined in claim 9 wherein said means for controlling the counting of said elements is also effective to change uniformly the spacing between adjacent said elements in response to changes in the compressibility of the fluid.

11. Apparatus for metering and dispensing a fluid and adapted to charge a refrigeration system with a liquid refrigerant said apparatus comprising a positive displacement pump having a movable fluid displacement member, means for moving said displacement member to effect dispensing of the fluid, a control system including an electro-optical means for sensing incremental movement of said displacement member, means for automatically adjusting said electro-optical means in response to changes in temperature of the fluid, said adjusting means including at least one rotary cam member, and means for rotating said cam member in response to changes in temperature of the fluid.

12. Apparatus for metering and dispensing a fluid and adapted to charge a refrigeration system with a liquid refrigerant, said apparatus comprising a positive displacement pump having a movable fluid displacement member, means for moving said displacement member to effect dispensing of the fluid, a control system including an electro-optical means for sensing incremental movement of said displacement member, means for automatically adjusting said electro-optical means in response to changes in temperature of the fluid, said electro-optical means including an elongated coil spring having helical turns, and means for counting said helical turns in response to movement of said displacement member.

13. In apparatus for metering and dispensing a fluid and adapted to charge a refrigeration system with a liquid refrigerant, said apparatus including a positive displacement pump having a movable fluid displacement member, means for moving said displacement member to effect dispensing of the fluid, and means for controlling the movement of said displacement member in response to changes in temperature of the fluid, the improvement wherein said means for controlling the movement of said displacement member comprise a deformable control member having a plurality of elements successively arranged generally in a row, means including an electro-optical unit for counting said elements in response to movement of said displacement member, means responsive to said counting means for controlling the movement of said displacement member, and means for deforming said control member for changing the spacing between adjacent said elements in response to changes in temperature of the fluid.

14. In apparatus for metering and dispensing a fluid and adapted to charge a refrigeration system with a liquid refrigerant, said apparatus including a positive displacement pump having a movable fluid displacement member, means for moving said displacement member to effect dispensing of the fluid, and means for controlling the movement of said displacement member in response to changes in temperature of the fluid, the improvement wherein said means for controlling the movement of said displacement member comprise an elongated coil spring having spaced helical turns, means for sensing and counting said helical turns in response to movement of said displacement member, and means for changing the length of said spring and uniformly changing the spacing between adjacent said turns of said spring in response to changes in temperature of the fluid.

15. Apparatus as defined in claim 14 wherein said means for changing the length of said spring, comprise a rotary cam member, drive means for rotating said cam member, and means for controlling said drive means in response to changes in temperature of the fluid.

16. Apparatus as defined in claim 15 including a second rotary cam member also rotated by said drive means, and means responsive to rotation of said second cam member for automatically controlling said sensing and counting means to compensate for changes in the compressibility of the fluid.

17. Apparatus as defined in claim 14 wherein said means for sensing and counting said elements comprise an electro-optical unit, and means connected to said displacement member and supporting said electro-optical unit for scanning movement adjacent said helical turns of said spring in response to movement of said displacement member.

18. Apparatus as defined in claim 14 including a digital display unit for indicating the weight of fluid dispensed by movement of said displacement member.

* * * * *